US011251536B2

(12) United States Patent
Skorczewski

(10) Patent No.: US 11,251,536 B2
(45) Date of Patent: Feb. 15, 2022

(54) LIGHTWEIGHT TUNEABLE INSULATED CHAFF MATERIAL

(71) Applicant: BAE Systems plc, London (GB)

(72) Inventor: Leon Paul Skorczewski, Preston (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 16/958,765

(22) PCT Filed: Jan. 3, 2019

(86) PCT No.: PCT/GB2019/050012
§ 371 (c)(1),
(2) Date: Jun. 29, 2020

(87) PCT Pub. No.: WO2019/135079
PCT Pub. Date: Jul. 11, 2019

(65) Prior Publication Data

US 2020/0328525 A1 Oct. 15, 2020

(30) Foreign Application Priority Data

Jan. 5, 2018 (EP) ..... 18250001
Jan. 5, 2018 (GB) ..... 1800653

(51) Int. Cl.
*H01Q 15/14* (2006.01)
*F42B 5/15* (2006.01)

(52) U.S. Cl.
CPC ..... *H01Q 15/145* (2013.01); *F42B 5/15* (2013.01)

(58) Field of Classification Search
CPC ..... H01Q 15/145; F42B 5/15
See application file for complete search history.

(56) References Cited

U.S. PATENT DOCUMENTS 4,942,090 A * 7/1990 Morin ..... D01F 11/127 428/367
5,087,515 A * 2/1992 Stevens ..... F41J 2/00 428/312.8
5,212,488 A * 5/1993 Konotchick ..... G01S 7/38 342/1

(Continued)

FOREIGN PATENT DOCUMENTS

EP 0171938 A2 2/1986
GB 834596 A 5/1960

(Continued)

OTHER PUBLICATIONS

Search Report for GB Appl. No. 1800653.6, dated Mar. 12, 2018, 3 Pages.

(Continued)

*Primary Examiner* — Marcus E Windrich
(74) *Attorney, Agent, or Firm* — Maine Cernota & Rardin

(57) ABSTRACT

There is provided an apparatus and method for disrupting radar systems. The apparatus comprises a chamber (110) for attachment to a vehicle, a radar countermeasure material (130) in the chamber, the radar countermeasure material comprising a plurality of hollow fibres, wherein the inner surface of at least some of the hollow fibres is at least partly coated with a conductive substance, and a release means (140) for dispensing the radar countermeasure material out of the chamber.

18 Claims, 3 Drawing Sheets

(56) References Cited

U.S. PATENT DOCUMENTS

| | | | | | |
|---|---|---|---|---|---|
| 5,352,519 | A | * | 10/1994 | Stevens | H01Q 15/145 428/359 |
| 5,619,205 | A | | 4/1997 | Johnson | |
| 5,900,831 | A | | 5/1999 | Eisele | |
| 6,017,628 | A | * | 1/2000 | Stevens | H01Q 17/00 205/119 |
| 6,578,492 | B1 | | 6/2003 | Koch | |

FOREIGN PATENT DOCUMENTS

| | | | |
|---|---|---|---|
| GB | 1325789 | A | 8/1973 |
| GB | 1325794 | A | 8/1973 |
| GB | 2505721 | A | 3/2014 |
| WO | 2010097620 | A1 | 9/2010 |

OTHER PUBLICATIONS

International Search Report and Written Opinion for PCT Appl. No. PCT/GB2019/0500512, dated Mar. 22, 2019, 13 Pages.
Search Report for EP Appl. No. 18250001.7, dated Jul. 4, 2018, 8 Pages.
International Preliminary Report on Patentability for PCT Appl. No. PCT/GB2019/050012, dated Jul. 16, 2020, 8 Pages.

* cited by examiner

LIGHTWEIGHT TUNEABLE INSULATED CHAFF MATERIAL

RELATED APPLICATIONS

This application is a national phase application filed under 35 USC § 371 of PCT Application No. PCT/GB2019/050012 with an International filing date of Jan. 3, 2019 which claims priority of GB Patent Application 1800653.6 filed Jan. 5, 2018 and EP Patent Application 18250001.7 filed Jan. 5, 2018. Each of these applications is herein incorporated by reference in their entirety for all purposes.

FIELD OF THE INVENTION

The present disclosure relates to an apparatus, method, and aircraft for disrupting radar systems.

BACKGROUND

Radar systems operate by transmitting radio waves, also known as radio signals, in a predetermined direction from a transmitter. Whilst certain objects in the path of the radar will absorb the signal, other objects, particularly conductive materials, will cause the signal to be reflected back to a receiver. By measuring the time taken to receive the reflected signal, as well as the direction of transmission and reception, the distance and general direction of the object causing the reflection can be determined.

Radar has particular use in military applications. It is often desirable to avoid detection by radar. One method of avoiding detection is by using decoy countermeasures that give a false impression of the target's location, or prevent a radar system "seeing" a target. It is an aim of the present invention to mitigate one or more problems associated with the prior art.

SUMMARY OF THE INVENTION

According to an aspect of the invention, there is provided an apparatus for disrupting radar systems, comprising a chamber for attachment to a vehicle (e.g. an aircraft), a countermeasure material (a radar countermeasure material) in the chamber, the countermeasure material comprising a plurality of hollow fibres, wherein the inner surface of at least some of the hollow fibres is at least party coated with a conductive substance, and a release means for dispensing the countermeasure material out of the chamber.

The hollow fibres may be made of an electrical insulating material. Preferably the hollow fibres are made of a dielectric insulator. The hollow fibres may be made of a plastic such as polystyrene, polypropylene, polyimide, polyethylene, polyethylene, polyethyleneterephthalate, polycarbonate, polyvinylfluoride, polytetrafluoroethylene, polychlorotrifluoroethylene, perfluoroalkoxy, fluorinated ethylene propylene, ethylene tetrafluoro ethylene, ethylene chlorotrifluoro ethylene and any combination thereof. The hollow fibres may be made of a glass, such as a silicate glass (e.g. fused quartz), alumino-borosilicate glass (e.g. E glass), aluminosilicate glass (e.g. S glass) or a borosilicate glass, e.g. Pyrex 7740. The hollow fibres may be made of a ceramic, such as alumina, barium zirconate, calcium zirconate, magnesium aluminium silicate, magnesium silicate, barium tantalate, titanium dioxide, niobium oxide, zirconia, sapphire, and beryllium oxide. Preferably, the hollow fibres are made of a non-electrically conductive material. Advantageously, using a non-electrically conductive (electrical insulating) material prevents the risk of electrostatic charge building up between hollow fibre members and therefore reduces clumping.

The exterior surface of the hollow fibres may not be coated with another substance. Preferably the exterior surface of the hollow fibres is not coated, partially or wholly, with an electrically conductive material which, for example, functions to hold static charge. More preferably the exterior surface of the hollow fibres is not coated, partially or wholly, with a metal.

Optionally the exterior surface of the hollow fibres is at least partly coated, or wholly coated, with an antistatic coating. The antistatic coating may be any suitable antistatic coating known in the field. For example the antistatic coating may be a polymer based antistatic coating, for example an epoxy based antistatic coating, polyurethane based antistatic coating or coatings based on stearic acid or a mixture of stearic and palmitic acid. Specific suitable examples include CA7850, 10P2-3, N59111, and Neofat 18. Advantageously, the use of an antistatic coating aids in reducing or preventing clumping. An antistatic coating, within the context of the present invention, is a compound or coating intentionally used for treatment of the hollow fibres in order to reduce or eliminate build-up of static electricity. Preferably the antistatic coating is not a metal based coating.

It is particularly preferred that the hollow fibres are made of electrically insulating (non-electrically conductive) material which is at least partly, or wholly, coated with an antistatic coating. This combination of the hollow fibres being made from electrically insulating material and the hollow fibres being externally coated with an antistatic coating advantageously work together to significantly reduce, or eliminate, the risk of electrostatic charge building up between hollow fibre members and thus significantly reduce clumping. Further, the use of an electrically insulating (non-electrically conductive) material advantageously reduces or eliminates the occurrence of shorting of internal systems if the hollow fibres inadvertently enter a vehicle (e.g. an aircraft), for example through an opening (e.g. an avionics door).

The inner surface of at least some of the hollow fibres is at least partly coated with a conductive substance. Preferably, the inner surface of at least some of the hollow fibres is wholly coated with a conductive substance, i.e. an electrically conductive substance. It is preferable that the inner surface is coated with a controlled thickness of a conductive substance.

The conductive substance is preferably capable of reflecting microwave energy. In other words, the conductive substance is preferably reflective to microwaves. Advantageously, this allows for the disruption of radar signals.

Optionally, the conductive substance is a metal or metal alloy. For example the conductive substance may be aluminium, silver (e.g. silver nitrate), nickel, copper, zinc, iron, tin, chromium, indium, gallium, or gold or any combination or alloys thereof. Advantageously, this allows for disruption of radar signals. Alternatively, the conductive substance is a conducting non-metal, such as graphite, or graphene, metalloids (such as silicon or germanium), metamaterials or any combination thereof.

Preferably, a length of the hollow fibres corresponds to radio frequency wavelengths used by the target radar system. This allows for optimal disruption of radar systems.

The length may correspond to half of or a multiple of the target radar signal's wavelength. Advantageously, this allows resonation of the hollow fibre on contact with the radar signal and subsequent re-radiation of the signal, providing maximum disruption of the radar system.

Preferably the chamber holds a range of lengths of countermeasure material (multiple frequency chambers). In other words, the chamber may hold hollow fibres, in accordance with aspects and embodiments described herein, with differing lengths. The hollow fibres may be packed in bands, wherein each band has hollow fibres of the same length but the separate bands have differing lengths of hollow fibres to each other. Advantageously, this allows for optimal disruption of multiple frequencies used by radar systems.

The countermeasure material may be stored in one or more cartridges in the chamber. Each cartridge may hold a range of lengths of countermeasure material. Alternatively, one cartridge may hold one length of countermeasure material (uniform frequency chamber). A further cartridge may hold a different length of countermeasure material (a different uniform frequency chamber).

Optionally, the release means comprises the chamber having an electronically controlled release mechanism. Advantageously, this provides an electronically assisted method of dispersing the countermeasure material. The release means may be a cover, such as a foil cover, that breaks as the countermeasure material is discharged.

Optionally, the release means comprises the chamber having a mechanically controlled release mechanism. Advantageously, this provides a mechanically assisted method of dispersing the countermeasure material.

Optionally, the apparatus comprises an ejection means for ejecting the countermeasure material out of the chamber. Advantageously, this improves dispersion of the countermeasure material, thereby aiding radar disruption.

A particularly preferred radar countermeasure material of the present invention comprises a plurality of hollow silicate glass fibres, wherein the inner surface (i.e. the internal surface of the hollow fibre) of at least some of the hollow glass fibres is at least partly coated with aluminium, silver or nickel, and the exterior surface of the hollow fibres (i.e. the external/outer surface of the hollow fibre) is at least partly coated with a coating comprising stearic acid. Preferably all of the hollow silicate glass fibres have their inner surfaces wholly coated with aluminium, silver or nickel and their exterior surfaces wholly coated with an epoxy based antistatic coating, polyurethane based antistatic coating or coatings based on stearic acid.

A further particularly preferred radar countermeasure material of the present invention comprises a plurality of hollow silicate glass fibres, wherein the inner surface (i.e. the internal surface of the hollow fibre) of at least some of the hollow glass fibres is at least partly coated with aluminium, silver or nickel, and the exterior surface of the hollow fibres (i.e. the external/outer surface of the hollow fibre) is not coated with another material. Preferably all of the hollow silicate glass fibres have their inner surfaces wholly coated with aluminium, silver or nickel and their exterior surfaces not coated at all.

According to an aspect of the invention there is provided a method for disrupting radar systems, comprising dispensing from a vehicle countermeasure material, wherein the countermeasure material comprises a plurality of hollow fibres and the inner surface of at least some of the hollow fibres is at least partly coated with a conductive substance.

According to an aspect of the invention there is provided an aircraft comprising the apparatus described above.

DETAILED DESCRIPTION

Chaff is a radar countermeasure material designed to provide false readings on radar systems. Chaff material typically comprises a mass of small, thin pieces of conductive material such as aluminium foil, strips or wire, which are loaded onto aircraft and dispersed into the air during flight. As the chaff material is conductive, incoming radar signals are reflected by the chaff material rather than (or as well as) the aircraft, thereby generating false radar echoes and making it difficult for the radar system to distinguish the aircraft from the chaff.

Typically, many thousands of chaff members are dispersed into the air during release, providing a clear tactical advantage in avoiding detection by the aircraft. Upon dispersal however, the chaff material can become trapped within the aircraft, thereby posing a risk of causing an electrical short-circuit in electronic systems due to the conductive nature. Furthermore, metallic chaff material is heavy, reducing the time of chaff in the air and making it more difficult to carry. In addition, a build-up of electrostatic charge between individual chaff members can cause chaff members to stick together, making dispersal more difficult.

Figure 1:
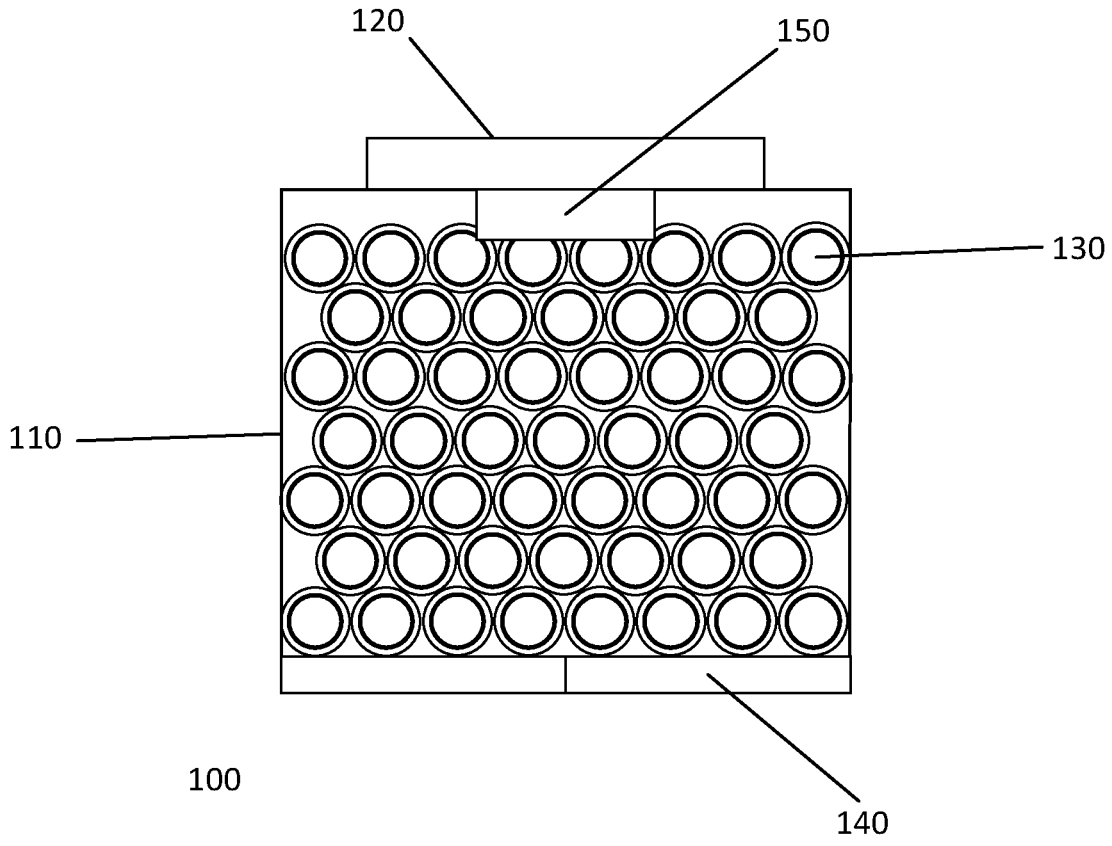
FIG. 1 shows an apparatus for disrupting radar systems.

FIG. 1 shows an apparatus 100 for disrupting radar systems. The apparatus 100 comprises a chamber 110 for attachment to a vehicle (for example an aircraft) via an attachment means 120. The apparatus 100 further comprises countermeasure material 130 in the chamber 110 wherein the countermeasure material 130 comprises a plurality of hollow fibres, wherein the inner surface of at least some of the hollow fibres is at least partly coated with a conductive substance. A release means 140 is provided for dispensing the countermeasure material 130 out of the chamber 110.

The attachment means 120 may releasably couple the chamber 110 to the vehicle, or alternatively may be integrated into the structure of the vehicle itself. Although the chamber 110 is shown as rectangular in FIG. 1, it will be appreciated that other shaped configurations of the chamber 110 are possible, such as cylindrical. The chamber 110 may be arranged to hold significant numbers of hollow fibre material (hundreds of thousands of individual hollow fibres). The chamber 110 may alternatively hold a plurality of individual cartridges containing the countermeasure material 130. FIG. 1 is not intended to restrict the countermeasure material 130 as being stored in a regular pattern as this is for illustration only, and furthermore FIG. 1 is not intended to indicate scale or quantity.

The release means 140 is for dispensing the countermeasure material 130 out of the chamber 110, such as an operable chamber opening. The release means 140 may comprise any suitable mechanical or electrically controlled release mechanism. The release means 140 may be manually activated, such as upon input from the pilot, or may be automatically activated, such as upon detection of radar signals, achieving a predetermined vehicle velocity or height, or upon determining a location of the vehicle within a particular region.

The chamber 110 may further comprise an ejection means 150 for ejecting the countermeasure material 130 out of the chamber 110, such as via mechanical or pyrotechnical methods. For example, methods may include dispersing the chaff material 130 via an actuator, a burst charge, a gas propellant, or any other suitable dispersion means.

Figure 2B:
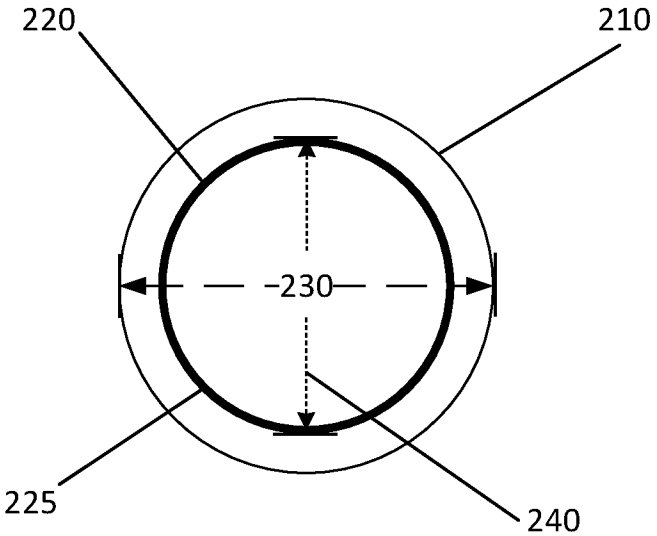
FIG. 2*b* shows a plan view of a hollow fibre countermeasure material.
Figure 2A:
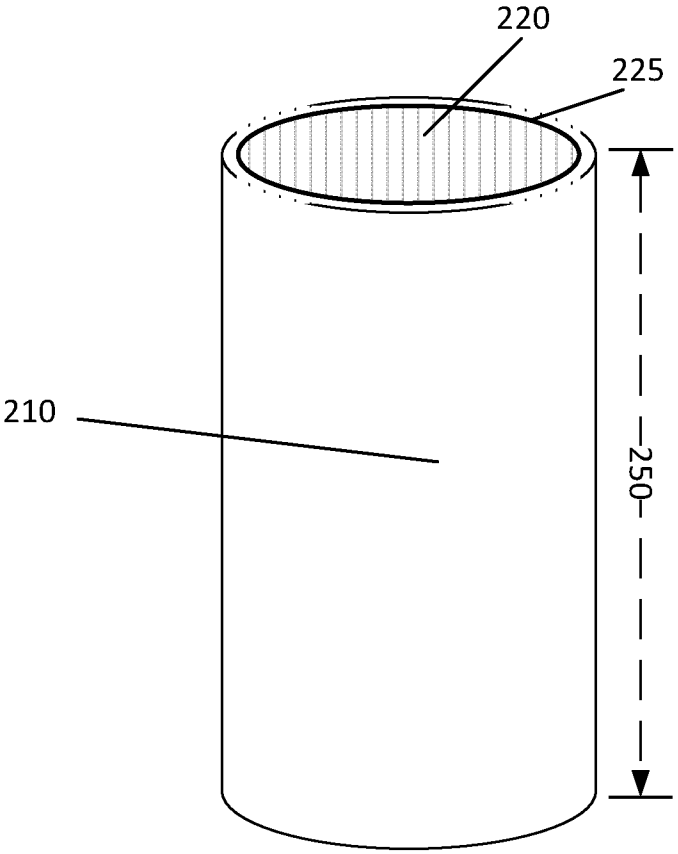
FIG. 2*a* shows a sectional view of a hollow fibre countermeasure material.

FIGS. 2*a* and 2*b* show a sectional and plan view respectively of a piece of the hollow fibre countermeasure material 130. The hollow fibres are made from a lightweight non-conductive or insulating material, such as dielectric insulator such as a glass, ceramic or plastic. Using a non-conductive (e.g. electrically non-conductive) material prevents the risk of electrostatic charge building up between members and therefore reduces clumping, and mitigates the short-circuit risk mentioned above. The outer surface 210 of the hollow fibre may also be at least partly coated with an antistatic coating to reduce clumping and therefore improve dispersion upon release from the chamber 110.

The inner surface 220 of the hollow fibre is at least partly coated with a conductive substance 225. For example, all of the inner surface, or greater than about 50% (for example greater than about 60, 70, 80, 90, 95, 96, 97, 98 or 99%) of the inner surface 220, may be coated with the conductive substance 225.

The inner surface coating may be applied through any suitable method, such as through the electroless metal deposition method described in earlier patent publication WO 2010/097620. Preferably the inner surface coating, the conductive substance 225, is electroplated. The conductive substance 225 may comprise any suitable material capable of reflecting microwave energy. For example, the conductive material 225 may be a metal, such as aluminium, silver, nickel, copper, zinc, gold, or iron, tin, chromium, indium, gallium, or a metal alloy thereof. Alternatively, the conductive substance 225 may be a conducting non-metal, such as graphite or graphene. By coating the inner surface 220 with a conductive material 225, such as a metal, the material reflects incoming radar waves and therefore assists in the disruption of radar systems as described above. However, by coating only the inner surfaces of otherwise non-conductive hollow fibre members, issues with material weight and clumping are avoided. Furthermore, as the outer surface 210 is still non-conductive, issues with causing short circuits are avoided.

The length 250 of the hollow fibres 130 may also be tuned to provide maximum radar interference. For example, the hollow fibres may be cut to a length 250 corresponding to radio frequency wavelengths of interest. The hollow fibres may be cut to a length 250 corresponding to half of a radar signal's wavelength, thereby causing the conductive material of the hollow fibre to resonate when hit by a radar signal and re-reradiate the signal. The hollow fibres may also be cut to a length 250 corresponding to a multiple of the wavelength of interest. The chamber 110 may comprise hollow fibres tuned to multiple lengths in order to overcome multiple frequencies. Alternatively, the chamber 110 may hold individual cartridges each containing a range of lengths of hollow fibre. Examples include hollow fibres having lengths of about 5-50 mm, for example about 5 mm, 10 mm, 15 mm, 20 mm, 25 mm, 30 mm, 35 mm, 40 mm, 45 mm and/or 50 mm, although other lengths may be utilised. For high frequency radar systems, the fibres may have very short lengths of about 100-1000 microns e.g. about 100, 200, 300, 400, 500, 600, 700, 800, 900 and/or 1000 microns. The hollow fibres may have a nominal outer diameter 230 of less than about 40 microns, for example about 2-30 microns, about 3-20 microns, about 5-15 microns, preferably about 10 microns, although other nominal outer diameters are envisaged. The hollow fibres may have a nominal internal diameter 240 of less than about 39 microns, for example about 1-38 microns, 3-10 microns, about 4-9 microns, preferably about 5-9 microns, although other internal diameters are envisaged. The nominal internal diameter 240 may be greater than about 50% of the nominal outer diameter 230, for example greater than about 60, 70, 75, 80, 85, 90 or 95%. The inner surface coating 220 may have a thickness of at least about 100 nm (for example at least about 200 nm, 300 nm, 400 nm, 500 nm, 1000 nm, 2000 nm, 5000 nm) Alternatively, the inner surface coating 220 may have a thickness of less than about 100 nm, less than about 50 nm, less than about 10 nm, less than about 1 nm, or less than about 0.5 nm. Preferably the inner surface coating has a thickness ranging from about 10 nm to 5000 nm. Preferably the inner surface coating is intentionally applied in the production of the hollow fibres. As such, it is preferable that the inner coating has a controlled thickness.

Figure 3:
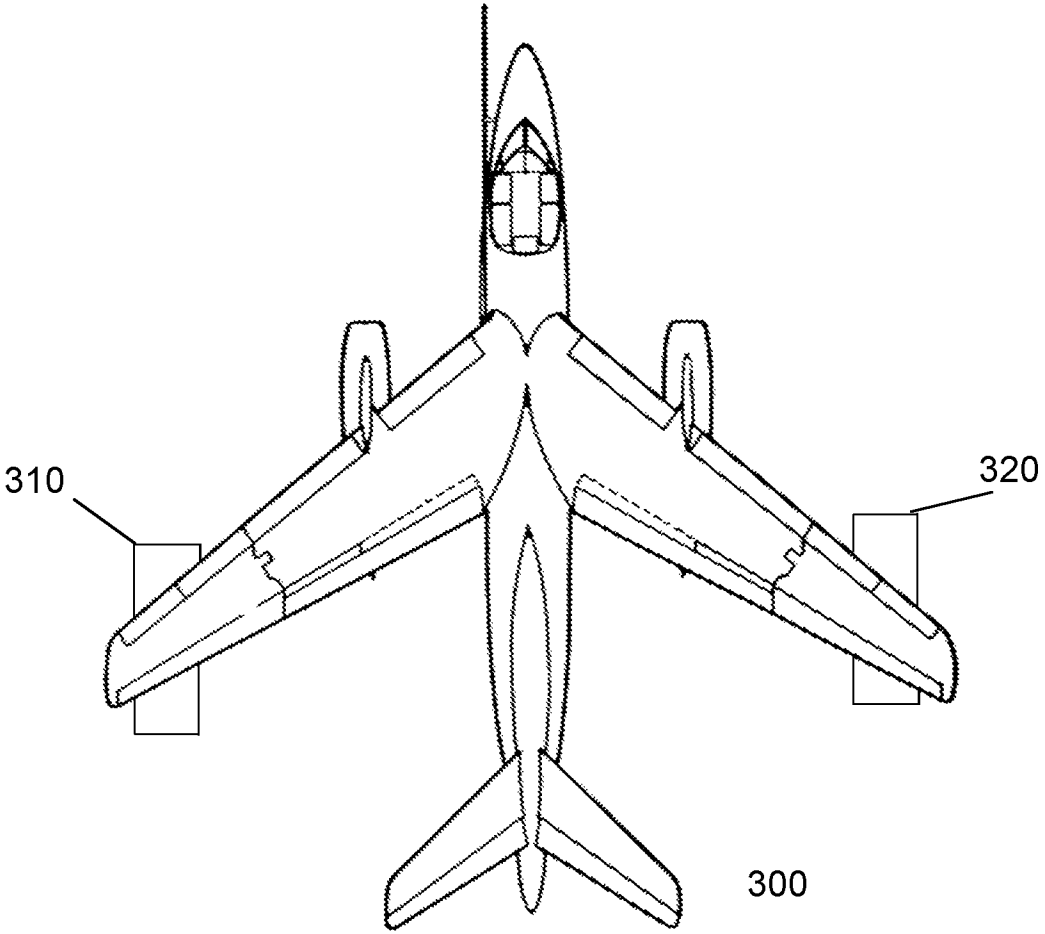
FIG. 3 shows an example aircraft comprising the apparatus.

FIG. 3 illustrates an example aircraft 300 comprising a plurality of chambers 310, 320 as described above. The chambers 310 and 320 are located on the wingtips of the aircraft 300, however other locations may be envisaged such as on the fuselage or tail of the aircraft 300. The chambers 310, 320 may also be attached to armament equipment on the aircraft 300. The chambers 310, 320 may be located externally or internally to the aircraft 300. The aircraft 300 may comprise one or more chambers containing the countermeasure material.

There is provided a method of disrupting radar systems using the apparatus disclosed above and as illustrated in FIGS. 1, 2*a* and 2*b*. The method comprises dispensing countermeasure material from a chamber attached to a vehicle, wherein the countermeasure material comprises a plurality of hollow fibres and the inner surface of at least some of the follow fibres is at least partly coated with a conductive substance.

The countermeasure material described herein provides significant weight advantages over known countermeasure material/chaff. It is considered that the countermeasure material described herein (for example aluminium internally coated silicate glass fibre) could be up to an order of magnitude lighter than its aluminium foil equivalent (for example, it is envisaged that 1 kg of the countermeasure material described herein may provide the same/similar volume coverage (and thus the same/similar effectiveness in radar detection avoidance) as up to 10 kg of conventional aluminium foil chaff.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term 'comprising' does not exclude the presence of other elements or steps.

Furthermore, the order of features in the claims does not imply any specific order in which the features must be performed and in particular the order of individual steps in a method claim does not imply that the steps must be performed in this order. Rather, the steps may be performed in any suitable order. In addition, singular references do not exclude a plurality. Thus, references to 'a', 'an', 'first', 'second', etc. do not preclude a plurality. In the claims, the term 'comprising' or "including" does not exclude the presence of other elements.

What is claimed is:

1. An apparatus (100) for disrupting a target radar system, comprising:

a chamber (110, 310, 320) for attachment to a vehicle;

a radar countermeasure material (130) in the chamber, the radar countermeasure material comprising a plurality of hollow fibres made of an insulating material, wherein the inner surface (220) of the hollow fibres is at least partly coated with a conductive substance (225) and wherein the outer surface of the plurality of hollow fibres is non-conductive;

wherein said outer surface (210) of said hollow fibre has no coating, and said conductive substance coating (225) has no overcoating; and a release means (140) for dispensing the radar countermeasure material out of the chamber.

2. The apparatus according to claim 1, wherein the conductive substance is a metal or metal alloy.

3. The apparatus according to claim 2, wherein the conductive substance is selected from aluminium, silver, nickel, copper, zinc, gold, iron, tin, chromium, indium, gallium or any combination thereof.

4. The apparatus according to claim 1, wherein the conductive substance is a conducting non-metal.

5. The apparatus according to claim 4, wherein the conductive substance is selected from graphite or graphene.

6. The apparatus according to claim 1, wherein a length of the hollow fibres corresponds to radio frequency wavelengths used by the target radar system and wherein the length corresponds to half of the target radar signal's wavelength.

7. The apparatus according to claim 1, wherein a length of the hollow fibres corresponds to radio frequency wavelengths used by the target radar system and wherein the length corresponds to a multiple of the target radar signal's wavelength.

8. The apparatus according to claim 1, wherein the chamber holds a range of lengths of radar countermeasure material.

9. The apparatus according to claim 1, wherein the radar countermeasure material is stored in one or more cartridges in the chamber.

10. The apparatus according to claim 9, wherein each cartridge holds a range of lengths of radar countermeasure material.

11. A method for disrupting radar systems, comprising the steps of:

providing a radar countermeasure material; and dispensing said radar countermeasure material (130), wherein the radar countermeasure material comprises a plurality of hollow fibres made of an insulating material, wherein the inner surface (220) of the hollow fibres is at least partly coated with a conductive substance (225) and wherein the outer surface of the plurality of hollow fibres is non-conductive;

wherein production of said plurality of hollow fibres comprises a step of applying said inner surface conductive substance coating (225) to said inner surface (220) of said plurality of hollow fibres; and wherein said outer surface (210) of said hollow fibre has no coating, and said conductive substance coating (225) has no overcoating.

12. An aircraft (300) comprising the apparatus of claim 1.

13. The apparatus according to claim 1, wherein an outer diameter of the hollow fibres is about 10 microns.

14. The apparatus according to claim 1, wherein an internal diameter of the hollow fibres is 5 to 9 microns.

15. The apparatus according to claim 1, wherein the inner surface coating conductive substance (225) has a controlled thickness and is applied in the production of the hollow fibres.

16. The apparatus according to claim 1, wherein the inner surface coating conductive substance (225) has a thickness ranging from about 10 nm to 5000 nm.

17. The apparatus according to claim 1, wherein the hollow fibres comprise silicate glass fibre, and the inner surface conductive substance (225) comprises exposed aluminium deposited by electroless metal deposition.

18. A system (100) for disrupting a target radar system, comprising:

a chamber (110, 310, 320) for attachment to a vehicle;

a radar countermeasure material (130) in the chamber;

said radar countermeasure material comprising:

a plurality of hollow fibres made of an insulating material;

wherein an internal diameter (240) of the hollow fibre is greater than about 50% of an outer diameter (230) of the hollow fibre;

wherein the inner surface (220) of the hollow fibres is at least partly coated with a conductive substance (225) and wherein the outer surface of the plurality of hollow fibres is non-conductive;

wherein the conductive substance inner coating (225) is exposed and electroplated on the inner surface;

wherein a thickness of the conductive substance (225) is about 100 nm and has a controlled thickness;

wherein said outer surface (210) of said hollow fibre has no coating, and said conductive substance coating (225) has no overcoating; and a release means (140) for dispensing the radar countermeasure material out of the chamber, whereby the target radar is disrupted.

* * * * *